US008590819B2

(12) United States Patent
Miles et al.

(10) Patent No.: US 8,590,819 B2
(45) Date of Patent: Nov. 26, 2013

(54) METHOD OF CONTROLLING WOOD PULP PRODUCTION IN A CHIP REFINER

(75) Inventors: Keith Miles, Montreal (CA); Lahoucine Ettaleb, Pointe-Claire (CA); Alain Roche, Montreal (CA)

(73) Assignee: FPinnovations, Pointe-Claire, Quebec (CA)

( * ) Notice: Subject to any disclaimer, the term of this patent is extended or adjusted under 35 U.S.C. 154(b) by 156 days.

(21) Appl. No.: 13/375,291

(22) PCT Filed: May 26, 2010

(86) PCT No.: PCT/CA2010/000805

§ 371 (c)(1),
(2), (4) Date: Feb. 22, 2012

(87) PCT Pub. No.: WO2010/139049

PCT Pub. Date: Dec. 9, 2010

(65) Prior Publication Data

US 2012/0138715 A1 Jun. 7, 2012

Related U.S. Application Data

(60) Provisional application No. 61/213,338, filed on Jun. 1, 2009.

(51) Int. Cl.
*B02C 1/00* (2006.01)
*B02C 11/08* (2006.01)

(52) U.S. Cl.
USPC ..... 241/28; 241/30; 241/33; 241/34; 241/35; 241/36; 241/37

(58) Field of Classification Search
USPC ..... 241/28, 30, 33–37
See application file for complete search history.

(56) References Cited

U.S. PATENT DOCUMENTS

| | | | | |
|---|---|---|---|---|
| 4,148,439 | A * | 4/1979 | Floden | 241/28 |
| 4,710,268 | A * | 12/1987 | Nilsson | 162/23 |
| 5,500,088 | A * | 3/1996 | Allison et al. | 162/198 |
| 6,336,602 | B1 * | 1/2002 | Miles | 241/28 |
| 6,752,165 | B2 * | 6/2004 | Johansson | 137/4 |
| 7,240,863 | B2 * | 7/2007 | Ettaleb et al. | 241/21 |

FOREIGN PATENT DOCUMENTS

| | | |
|---|---|---|
| CA | 2130277 | 2/1995 |
| CA | 2595551 | 8/2006 |
| WO | 2008134885 | 11/2008 |

OTHER PUBLICATIONS

Owen et al., A practical approach to operator acceptance of advanced control with dual functionality, Preprints of Control Systems'98 conference, Porvoo, Finland, Sep. 1-3, 1998, pp. 182-194.

Eriksen et al., Theoretical estimates of expected refining zone pressure in a mill scale TMP refiner, Nordic Pulp & Paper Research Journal (2006), 21(1), pp. 82-89.

(Continued)

*Primary Examiner* — Dana Ross
*Assistant Examiner* — Onekki Jolly
(74) *Attorney, Agent, or Firm* — Norton Rose Fulbright Canada LLP

(57) ABSTRACT

A method has been developed that estimates from the on line measurements of readily available process variables the proportion of the mass of fiber in the refining zone of a chip refiner relative to the mass with a full refining zone. This estimate of the filling factor is used to determine the margin available to load the refiner and the control action needed to avoid abnormal operation.

20 Claims, 7 Drawing Sheets

(56) References Cited

OTHER PUBLICATIONS

Miles, A Simplified Method for Calculating the Residence Time and Refining Intensity in a Chip Refiner, Paperi ja Puu, vol. 73/No. 9 (1991).

* cited by examiner

METHOD OF CONTROLLING WOOD PULP PRODUCTION IN A CHIP REFINER

CROSS-REFERENCE TO RELATED APPLICATIONS

This application is a National entry of PCT/CA2010/000805 filed May 26, 2010, in which the United States of America was designated and elected, and which remains pending in the International phase until Dec. 1, 2011, which application in turn claims priority under 35 USC 119(e) from U.S. Provisional Application Ser. No. 61/213,338, filed Jun. 1, 2009.

TECHNICAL FIELD

The present invention relates to a method of controlling quality of wood pulp produced in a chip refiner, in particular a method of assessing on-line the ability to load a chip refiner and to avoid running the unit in an undesirable operating range. The refiner load is highly related to the mass of fibre in the refining zone. Insufficient fibre mass or a fibre mass in excess of what can be normally accommodated in the refining zone volume results in difficulties in loading the refiner and in a deterioration of the quality of the pulp produced. A filling factor is estimated on-line and used to assess operating conditions and take control action if needed.

BACKGROUND ART

Loading of Chip Refiners

The quality of mechanical pulp is very much a function of the energy applied per tonne of production, i.e.: the specific energy. It is therefore very important to be able to adjust the refiner motor loads in order to develop the required specific energy for the pulp quality needed. Most refiners are hydraulically loaded and the normal way to increase refiner motor load is by increasing the axial thrust with more hydraulic pressure. Higher shear force on the fibre is developed resulting in an increase in the torque and in the motor load. Plate gap is reduced.

It has been well established that it might not be possible to reach maximum motor load as defined by the motor capacity. Allison et al. CA 2130277 propose a method to determine the maximum achievable motor load and to operate slightly below this maximum motor load. Owen et al., "A practical approach to operator acceptance of advanced control with dual functionality", Preprints of Control Systems'98 conference, Porvoo, Finland. Sep. 1-3, 1998, developed a control technique to ensure that the refiner is operated below maximum motor load in order to avoid its sudden drop and also to avoid a sudden drop in the pulp quality. In addition they carried out experiments demonstrating that operating beyond maximum motor load results in fibre cutting and loss of pulp strength properties. Although these two developments represent a significant step towards defining a suitable operating range for a refiner, the fundamental reasons for the difficulties in loading the refiners have not been investigated. As the result, corrective measures are empirical and limited to plate gap adjustments which generally do not correct the problem at the source. These developments apply to certain types of refiners that respond quickly to changes in hydraulic pressure set-points and which are equipped with plate position or plate gap sensors.

Eriksen et al., "Theoretical estimates of expected refining zone pressure in a mill scale TMP refiner" Nordic Pulp & Paper Research Journal (2006), 21(1), 82-89, estimated the mechanical pressure from the pulp in a twin refiner as a function of the amount of fibres covering the bars of the plates. However they never consider the problem of loading the refiner and the loading being related to the mass of fibre in the refining zone.

Nowhere in the literature is there a mention of the possibility that difficulties in loading the refiners could be associated with the mass of fibre in the refining zone, the refining zone becoming full or having an insufficient fibre mass. This, however, is important for monitoring process operation and taking corrective measures.

Pulp Residence Time

The estimation of pulp residence time in the refining zone is a key element for the estimation of the mass of fibre in the refining zone. Pioneering work in this area by Miles, "A Simplified Method for Calculating the Residence Time and Refining Intensity in a Chip Refiner" Paperi ja Puu, Vol. 73/No. 9 (1991), has led to the concept of refining intensity but no effort has been made to use it to estimate the mass of fibre in the refiner and its maximum value.

DISCLOSURE OF THE INVENTION

This invention seeks to provide a method of controlling quality of wood pulp produced in a chip refiner.

In accordance with the invention there is provide a method of controlling quality of wood pulp produced in a chip refiner comprising:

refining wood chips in a refining zone of a chip refiner with formation of a mass of pulp fibre, determining a fibre filling factor of the fibre in said refining zone, and adjusting as necessary, at least one operating parameter of the chip refiner, in response to the filing factor determined, to achieve a desired pulp quality.

The key element of this invention is a method which permits to estimate on-line the degree of filling of the refining zone of a refiner and the use of this estimate to properly load the refiner and avoid some of the detrimental impact on pulp quality of operating with too much or not enough fibre mass. Both actual mass of fibre in the refining zone and mass when the refiner is full are estimated and compared giving a filling factor that is used to adjust the refiner if needed. The invention is comprised of:

a method to estimate the mass of fibre in the refining zone;

a method to estimate the mass of fibre when the refiner is full;

a method to estimate a filling factor;

a method of using the filling factor to avoid operating in undesirable regions where pulp quality deteriorates.

DETAILED DESCRIPTION OF THE INVENTION

Loading of a Refiner

Most of the production of mechanical pulp is made from wood chips using disc refiners. A large amount of electrical energy, 2000 to 3000 kWh per tonne of production is used to separate and develop the fibres. The quality of the pulp produced is mostly a function of the energy applied per tonne of production and to a certain extent of the condition under which this energy is applied, i.e. the refining intensity or refining consistency.

Changing the motor load and the energy applied can be done by changing the refining consistency (the dilution flows), the production rate, but primarily by changing the hydraulic pressure applied on the refining plates.

Increasing hydraulic pressure results in a higher thrust load and in an increase in the mechanical force on the pulp. The thrust load is balanced against the sum of the mechanical force on the pulp and the force developed by the steam pressure on the plates.

An increase in mechanical force on the pulp leads to a greater shear force and therefore a higher torque and motor load. It can ultimately lead to excessive shear stress on the pulp.

Fibre Mass and Motor Load

The mass of fibre in the refining zone is the product of the production rate and the pulp residence time. The production rate is normally estimated from the feeder speed and a calibration factor proportional to the bulk density of the feed material. The residence time of the pulp can be estimated using the model developed by Miles "A Simplified Method for Calculating the Residence Time and Refining Intensity in a Chip Refiner" Paperi ja Puu, Vol. 73/No. 9(1991), based on a balance of the forces acting on the pulp. This residence time depends mostly on the specific energy and the refining consistency, increasing with both of these variables.

Figure 1:
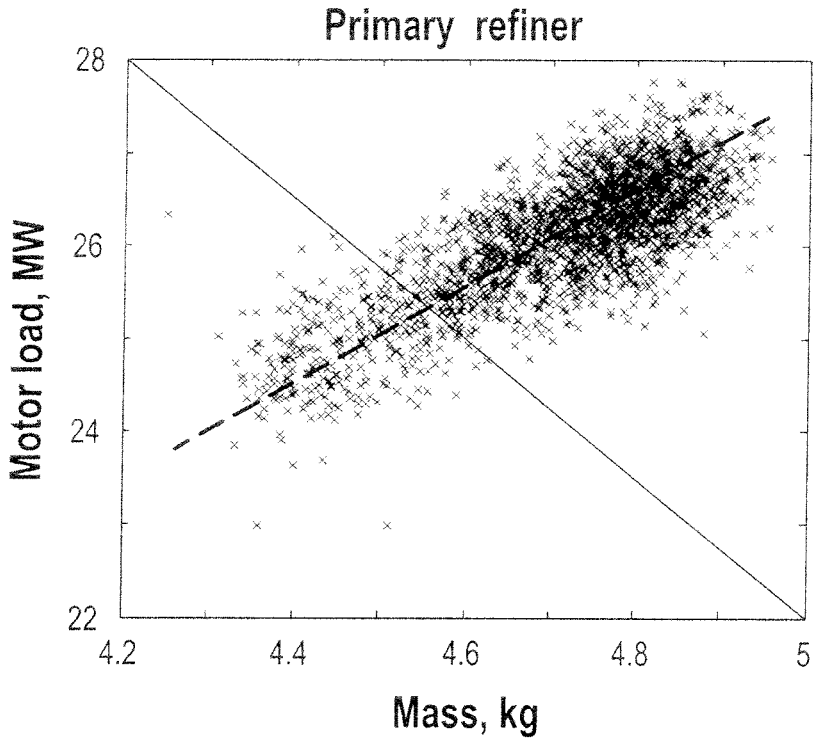
FIG. 1 illustrates graphically the relationship between motor load of a primary refiner and the fibre mass inside the refining zone, and that they are linearly related. Indeed, the development of refiner motor load requires a sufficient mass of fibre in the refining zone.

The mass of fibre in the refining zone plays an important role in the loading of a refiner. Indeed, there is a limit to the shear stress that the fibre can take before it breaks down. The mass of fibre in the refining zone must be sufficient to provide the surface area needed to develop the shear force and the torque required for the desired motor load. This is well illustrated in FIG. 1 where operating data for a primary refiner show the motor load to be proportional to the mass of fibre in the refining zone.

Figure 2:
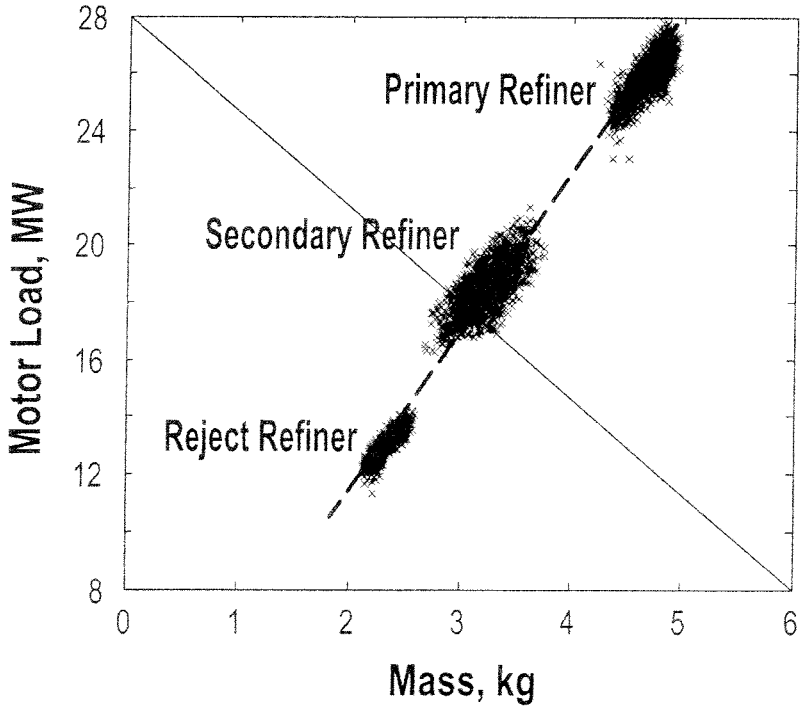
FIG. 2 illustrates graphically the relationship between motor load of primary, secondary and reject refiners and the mass of fibre inside the refining zone. Despite very different operating ranges the three refiners are on the same linear characteristic.

This is further illustrated in a comparison of operating data for a single line TMP mill as shown in FIG. 2. The three refiners, primary, secondary, and reject refiners are identical equipment. The plot of motor load versus mass of fibre for the three refiners is on the same linear characteristic but the ranges of operation are quite different.

Although the secondary refiner has the same pulp throughput as the primary refiner, it is not operated with the same mass of fibre in the refining zone and therefore not in the same motor load range. Refining less bulky and more developed fibre than the primary refiner, the secondary refiner is operated at lower specific energy which reduces the pulp residence time and the mass of fibre in the refining zone.

The reject refiner processes only between thirty and forty percent of the main line production and a high proportion of long fibre. Compared to the secondary refiner, more specific energy can be applied than on the secondary refiner giving a higher residence time and therefore a mass of fibre greater than what would be expected from the lower throughput.

Knowledge of the mass of fibre in the refining zone can help to avoid conditions where refiner loading is not possible.

Loading with Insufficient Fibre Mass

Insufficient fibre mass in the refining zone can prevent proper loading of the refiner. Typical of such conditions are operations at refining consistencies that are too low. Residence time decreases with refining consistency reducing the mass of fibre in the refining zone at constant throughput. Attempts to maintain motor load by closing the plate gap increases the shear stress leading to fibre cutting and a drop of motor load and specific energy. The drop of specific energy further reduces the pulp residence time and the mass of fibre. More fibre cutting and further drop in motor load and mass of fibre are taking place.

Figure 3:
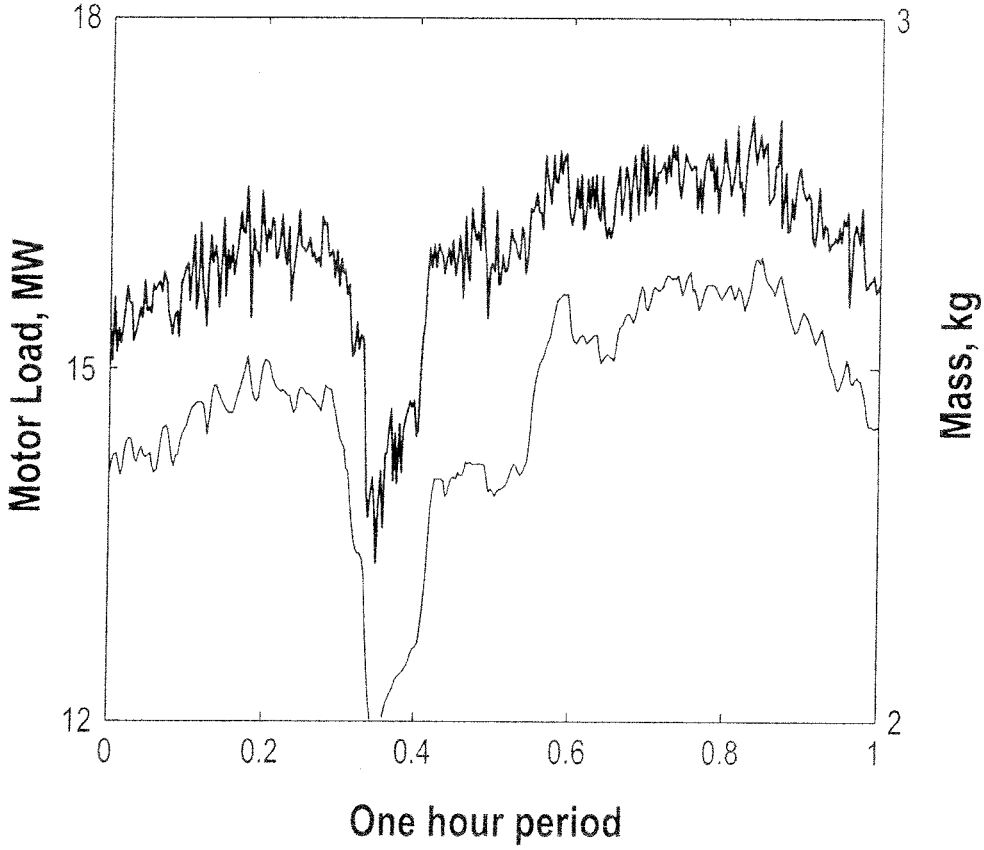
FIG. 3 is a specific example which illustrates graphically insufficient fibre mass to maintain the load of the refiner.
Figure 4:
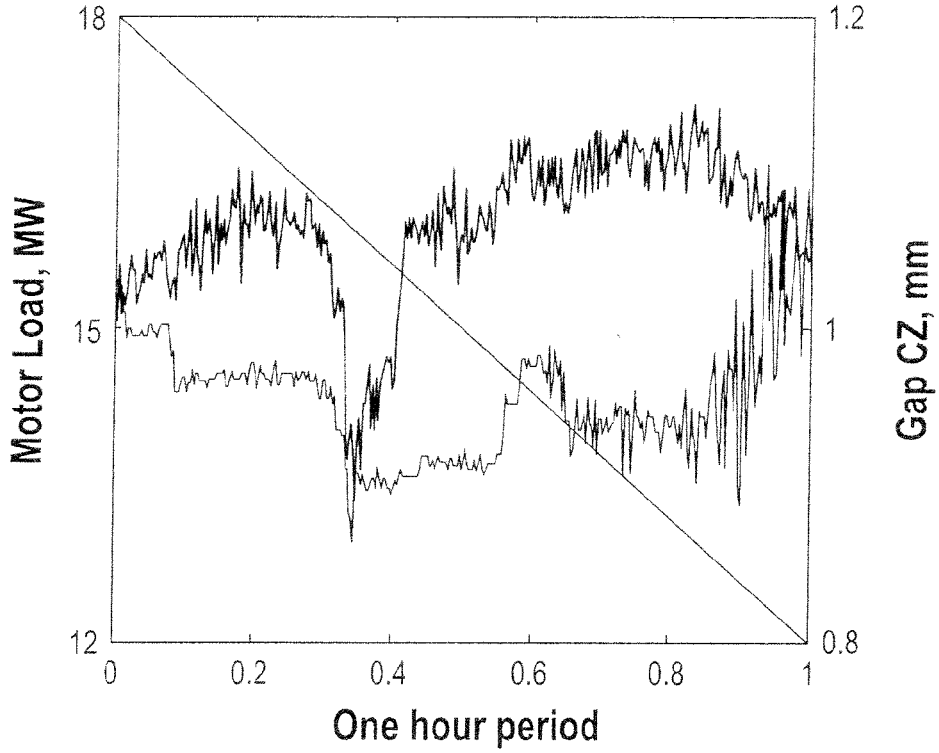
FIG. 4 illustrates graphically the relationship between motor load and refiner plate gap, showing that shortly after 0.2, closing the refiner plate gap causes the motor load to drop rapidly. The mass of fibre is not sufficient to develop the required shear force with acceptable shear stress.

This is illustrated in FIG. 3 which shows a rapid drop in fibre mass and motor load despite the closing of plate gap (FIG. 4).

Filling Up the Refining Zone

Figure 5:
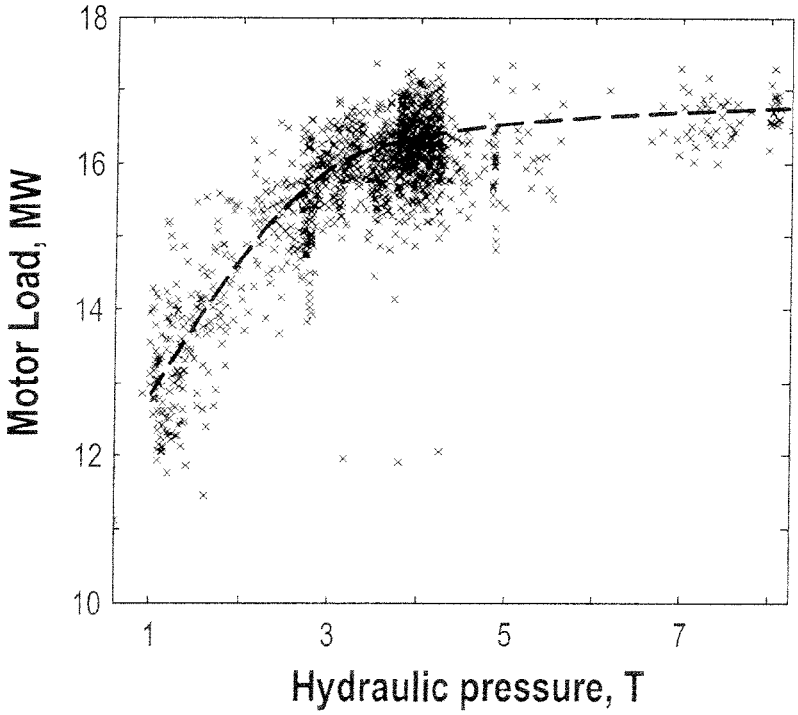
FIG. 5 illustrates graphically the relationship between motor load and hydraulic pressure (thrust). As the refining zone becomes full, the motor load reaches its maximum value and does not increase with hydraulic pressure.

At constant production rate, the pulp residence time and therefore the mass of fibre in the refining zone will increase if more specific energy (higher motor load) is applied. At constant specific energy and refining consistency, the mass of fibre will increase with production rate. In both cases, a point is reached where it becomes impossible to increase the load on the refiner and where the quality of the pulp starts to deteriorate. In all these situations, as the refining zone becomes filled up with fibre, less and less space remains available to accommodate the increasing amount of steam generated with increasing motor load. The steam pressure increases almost exponentially. The hydraulic thrust needed to balance the force exerted by the steam pressure on the plates exceeds the capacity of the hydraulic system and it becomes impossible to increase the motor load. Maximum motor load has been reached. This is illustrated in FIG. 5 which shows for a reject refiner the motor load achieved as a function of the hydraulic pressure. As the hydraulic thrust continues to increase, the motor load remains constant. The limit of the hydraulic system is reached and the motor load is at its maximum value.

The other important phenomenon is the deterioration of the strength properties of the pulp. When the increased mass of fibre resulting from higher production rate or residence time has led to occupation of all refining zone area, any attempt to raise motor load will lead to a proportional increase in shear stress on the pulp. This results in fibre shortening.

On-Line Estimation of the Filling Factor

As mentioned previously, the mass of fibre in the refining zone is directly estimated from the product of the production rate by the pulp residence time.

There are different methods to estimate the mass of fibre in the refining zone when the refiner is full.

The first one is the product of the refining zone volume and the pulp density. The refining zone volume depends on the physical characteristics of the plates. It varies with the plate gap, which is generally measured on-line, and with the actual wear of the plate which is more difficult to estimate. The density of the pulp is not measured on-line. Such a method is fairly cumbersome.

Figure 6:
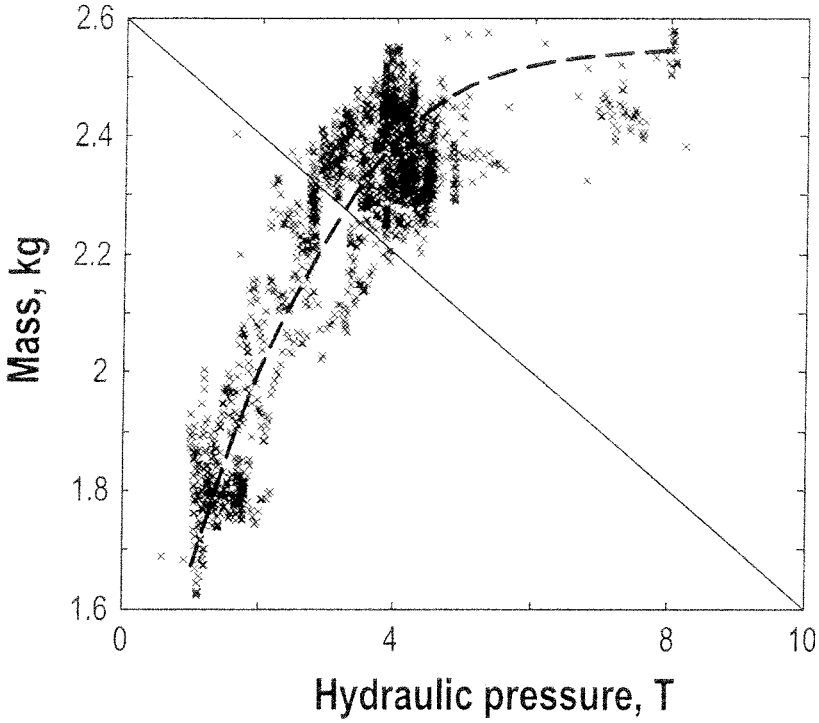
FIG. 6 illustrates graphically the relationship between mass of fibre in refining zone versus thrust or hydraulic pressure.
Figure 7:
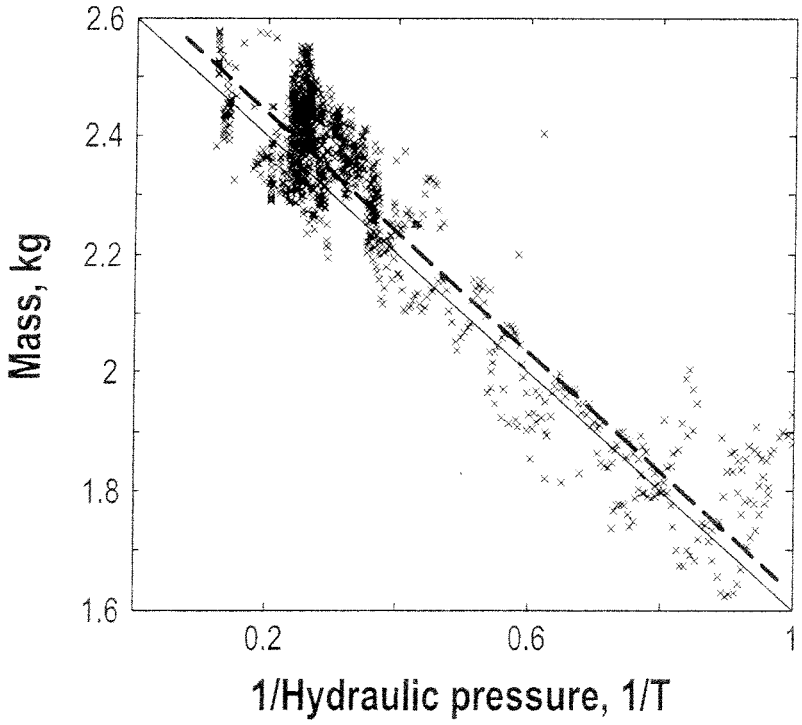
FIG. 7 illustrates graphically the relationship that the mass of fibre in the refining zone is linearly related to the inverse of the thrust or the inverse of the hydraulic pressure. The mass of fibre when the refiner is full can be estimated from the value of the characteristic at the origin.

The other approach which is the preferred one is based on the relationship between the axial thrust and the mass of fibre in the refining zone. The axial thrust needed to maintain the motor load increases very rapidly as the refining zone becomes full. This is illustrated with operating data from a mill reject refiner. As the hydraulic pressure is increased the motor load (FIG. 5) and the mass of fibre (FIG. 6) remain constant. The refiner is full. The mass of fibre is linearly related to the inverse of the axial thrust or the inverse of the hydraulic pressure as shown in FIG. 7. This linear characteristic, inverse of the axial thrust versus fibre mass is estimated on-line from direct measurements of the axial thrust and the estimations of fibre mass. This linear relationship is of the form:

$$m = a - \frac{b}{T}$$

where m is the fibre mass in the refining zone, a is an estimate of the fibre mass when the refiner is full, b is the slope of the linear relationship and T is the thrust.

The coefficient a and the coefficient b are easily determined using one of the on-line calculation methods such as recursive least squares. The coefficient a would then define the mass corresponding to the refiner being full. This linear relationship is solely used to determine the coefficient a. The actual refining zone mass, in, is determined from the production rate multiplied by the residence time as mentioned previously. The filling factor estimate is defined by:

$$\text{Filling Factor } (\%) = \frac{100m}{a}$$

which is the ratio of the current fibre mass to the fibre mass when the refiner is full.

The maximum mass of fibre in the refining zone or the mass of fibre for which the refiner is full, a, may vary according to plate wear, plate gap, refining consistency, and properties of the material being refined.

Particular Conditions for Conical Disc Refiners

Flat disc refiners are loaded entirely from axial thrust and the estimation of filling factor can be performed in all operating conditions. Conical refiners are comprised of a flat zone but also of a conical zone that constitutes the bulk of the refining zone.

In the conical zone, because of the geometrical configuration, the centrifugal force has a major contribution to the development of the torque and the motor load. Conditions exist where the inlet steam pressure is not sufficient and negative thrust is applied to maintain the required motor load. The refiner then is entirely loaded from the centrifugal force. Although it is possible to operate for extended periods of time under these conditions it is not a desirable operation from the point of view of refiner stability and controllability.

The method used to estimate the filling factor is valid for conical refiners as long as the hydraulic thrust remains positive. The on-line estimation is suspended as soon as the hydraulic thrust becomes negative.

Monitoring and Control

The estimators for the mass of fibre in the refining zone and the filling factor can be considered as soil sensors whose outputs can be displayed on the operator console and used for monitoring the refiner operations and for taking control action.

In particular the filling factor will indicate if there is some margin for raising production or increasing the specific energy. It can trigger an alarm to indicate that the refiner has reached the capacity limitation and that pulp quality will deteriorate. It can be used to suggest or initiate control actions such as reducing production rate or lowering specific energy.

Figure 8:
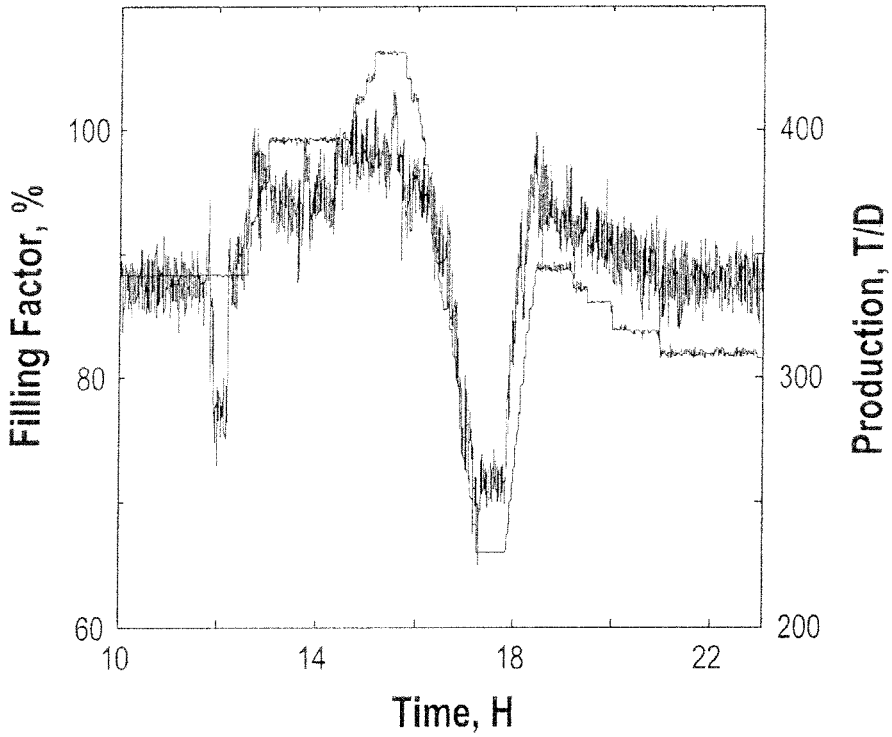
FIG. 8 illustrates graphically the relationship between filling factor and production rate in a reject refiner. The refining zone becomes full when the production reaches 400 tonnes per day.
Figure 9:
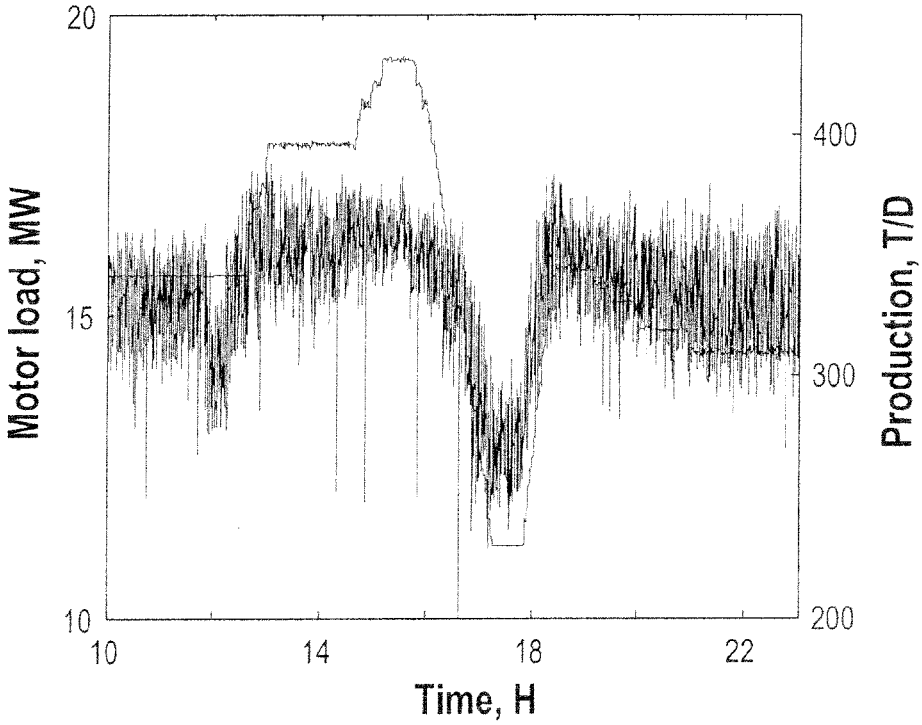
FIG. 9 illustrates graphically the relationship between Motor load and Production rate. When the refining zone is full it is not possible to increase the motor load despite increasing throughput.

An example of the use of the filling factor is illustrated in FIG. 8 that shows over a period of operation the production rate and the calculated filling factor. It is clear that from 10:30 hours until 13:30 hours the tilling factor is rising towards 100%, the production rate becomes too high to permit adequate refining and as shown in FIG. 9 the motor load remained unchanged at the maximum achievable value. The production rate should have been limited to less than 400 tonnes per day during that period.

Around 12.00 hours in FIG. 8 there was a sudden drop of the filling factor at constant production. This was the result of an increase in the dilution water flow. The pulp residence time and the mass of fibre in the refining zone decrease. This illustrates a use of dilution water to adjust the mass of fibre in the refining zone and the filling factor.

The method of the invention may thus rely on the following steps:

1. A method to estimate on-line the mass of fibre in the refining zone.
2. A method to estimate on-line the mass of fibre when the refiner is full.
3. A method to estimate on-line the filling factor of a refiner.
4. The use of the filling factor to maintain a refiner in a suitable operating range where the refiner can be properly loaded.

In particular the method thus contemplates determining the filling factor from the actual mass of fibres in the refining zone and the mass of fibres in the refining zone when the refining zone is full.

The actual mass of fibres in the refining zone may be determined from a measured production rate of the chip refiner and pulp residence time in the refining zone.

The mass of fibre in the refining zone when said zone is full may be determined from the axial thrust developed by hydraulic pressure in said refining.

The filling factor is suitably monitored throughout the refining in the refining zone, and the at least one operating parameter is adjusted, as necessary, in response to the determined filling factor.

Figure 10:
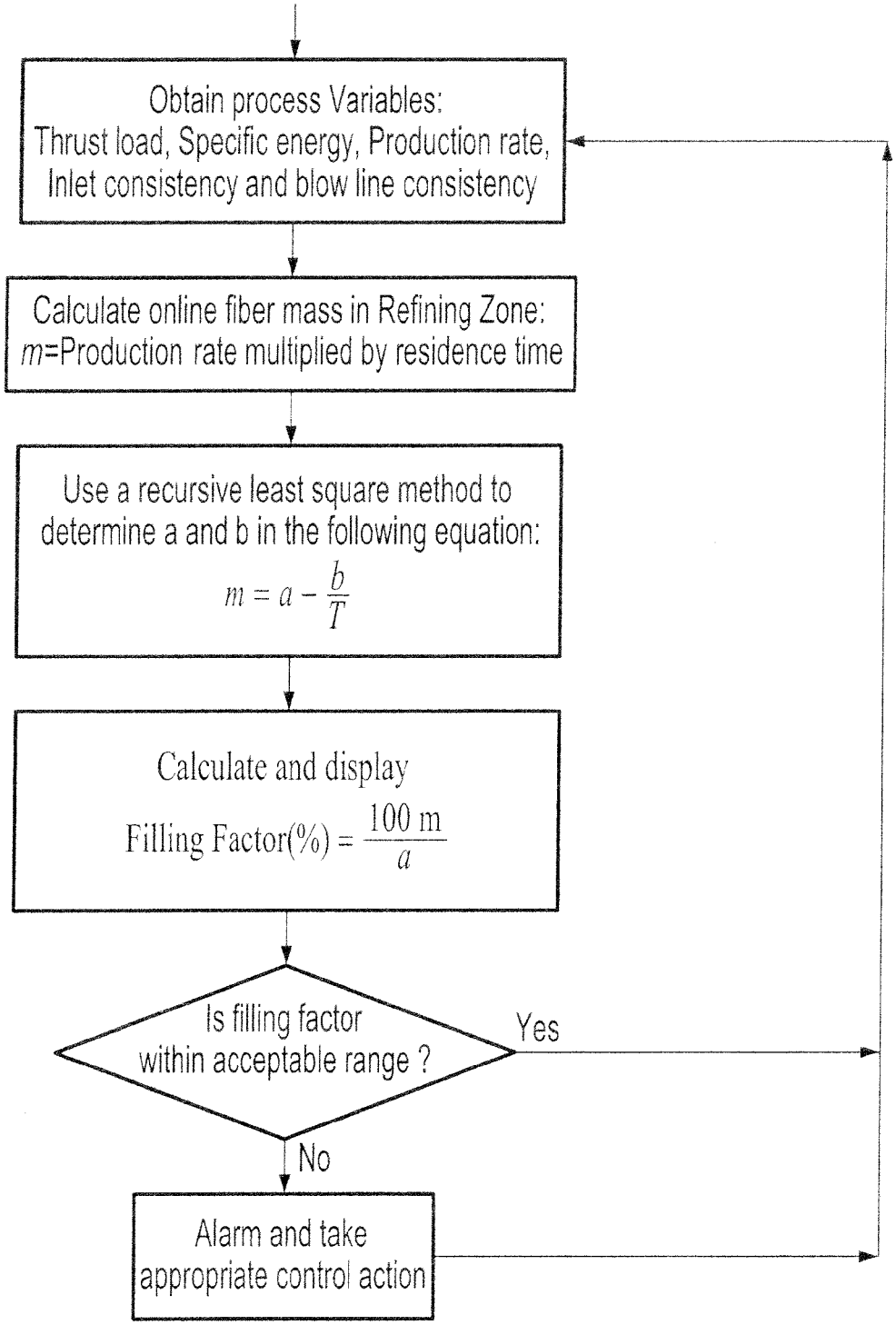
FIG. 10 is a Flow Chart illustrating the method of the invention.

This is further illustrated in the flowchart of FIG. 10, starting with an update, with current values, of the process variables such as thrust load, specific energy, production rate, blow line consistency and inlet consistency, needed for the calculation of the filling factor. The fibre mass in the refining zone, the fibre mass when the refiner is full, and the filling factor are then calculated as described above and the filling factor is displayed. If the filling factor is within acceptable range the procedure is repeated starting with an update of the process variables. If the filling factor is too low or too high, an alarm is triggered and an appropriate control action such as a reduction or an increase of the production rate, or a reduction of the energy applied. Once the corrective action has been taken, the procedure is resumed starting with the current values of the process variables.

DESCRIPTION OF THE PREFERRED EMBODIMENT

Figure 11:
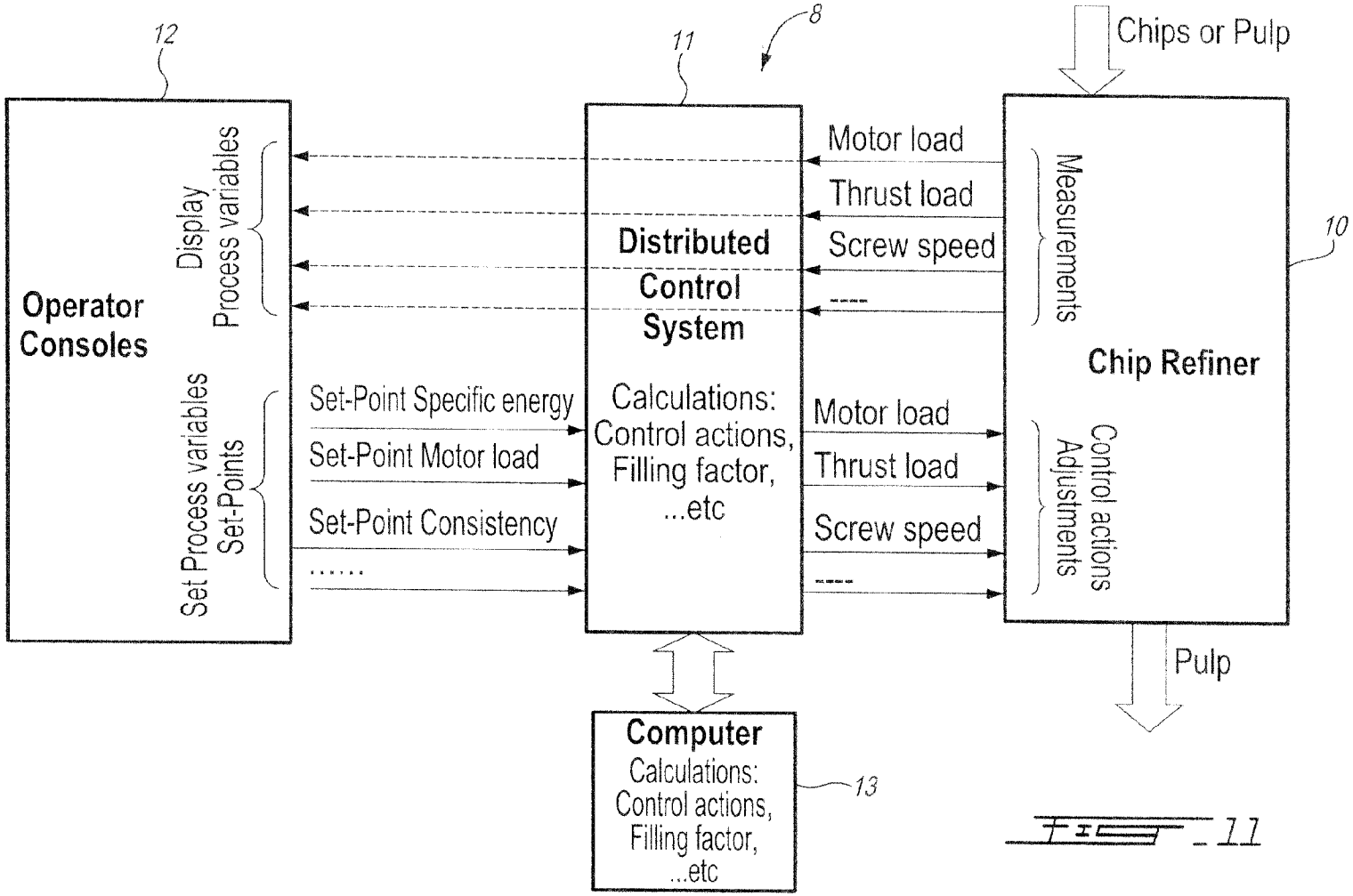
FIG. 11 is a Block Diagram of an apparatus for carrying out the method of the invention.

FIG. 11 illustrates an implementation in a distributed control system (DCS), the typical hardware used in pulp and paper mill to perform process monitoring and control functions. In particular FIG. 11 shows an assembly 8 of a chip refiner 10 having an inlet 15 for wood chips or pulp to be refined and an outlet 17 for refined pulp; a distributed control system (DCS) 11 in operative communication with chip refiner 10; an operator console 12 in operative communication with distributed control system (DCS) 11; and an optional computer 13 in operative communication with distributed control system (DCS) 11. The chip refiner 10 defines a refining zone (not shown). The distributed control system (DCS) 11 may be programmed to make the determination of the filling factor in which case the computer 13 is not required, or the computer 13 may be programmed to make the determination of the filling factor and communicate the information of the determination to the distributed control system (DCS) 11.

Process variables such as thrust load, specific energy, production rate, blow line consistency and inlet consistency are readily available in the DCS 11 of most mills either from direct measurement on the process proceeding in chip refiner 10 or through calculations. In most current mill installations, theses variables are controlled and their set-points are adjustable. Connected to the DCS 11 are the operator consoles 12 and in many cases the computer system 13.

A preferred embodiment is to have the software that perform the calculation of the mass of fibre in the refining zone of chip refiner 10, and the calculation of the filling factor programmed in the DCS 11 with the alarm displayed on the operator console 12.

For older installations, with a DCS 11 limited in computing capacity, another embodiment will be to have the software that estimates filling factor implemented in a computer 13 connected to the DCS 11.

As illustrated in FIG. 11, measurements of operating parameters of the chip refiner 10, such as motor load, thrust load and screw speed are collected by the DCS 11 and adjustment or control of these parameters of the chip refiner 10 is initiated and handled by the DCS 11. In formation and data for calculations, control actions and of the filling factor etc., are part of the communication between DCS 11 and computer 13. The operator console 12 displays information and data of the process variables or operating parameters of the chip refiner 10; as well as set process variables and set points such as specific energy, motor load and consistency which are communicated to the DCS 11 for control and adjustment of operating parameters of the chip refiner 10.

The determination of filling factor may be carried out continuously or on a periodic or continual basis, but in the case of the latter the determination will be disabled at short term intervals.

The invention claimed is:

1. A method of controlling quality of wood pulp produced in a chip refiner comprising:

refining wood chips in a refining zone of a chip refiner with formation of a mass of pulp fibre, determining a fibre filling factor of the fibre in said refining zone from the actual mass of fibres in the refining zone and the mass of fibres in the refining zone when the refining zone is full, and adjusting as necessary, at least one operating parameter of the chip refiner, in response to the filing factor determined, to achieve a desired pulp quality.

2. A method according to claim 1, including a step of determining the actual mass of fibres in the refining zone from a measured production rate of the chip refiner and pulp residence time in the refining zone.

3. A method according to claim 1, including a step of determining the mass of fibre in the refining zone when said zone is full, from the axial thrust developed by hydraulic pressure in said refining.

4. A method according to claim 1, wherein said filling factor is monitored throughout the refining in the refining zone, and said at least one operating parameter is adjusted, as necessary, in response to the determined filling factor.

5. A method according to claim 1, carried out in an in-line process for producing wood pulp from wood chips.

6. A method according to claim 1, wherein in response to a determination of a filling factor outside an acceptable range, said at least one operating parameter is adjusted to restore the filling factor to the acceptable range.

7. A method according to claim 6, wherein an alarm is triggered when said determination is of said filling factor outside said acceptable range, and said at least one operating parameter is adjusted in response to said alarm.

8. A method according to claim 1, wherein in response to a determination of a filling factor within an acceptable range, said at least one operating parameter is maintained without adjustment.

9. A method according to claim 1, wherein said at least one operating parameter is selected from reduction of production rate, increase in production rate and reduction of energy input.

10. An apparatus for controlling quality of wood pulp produced in a chip refiner, comprising a chip refiner defining a refining zone and having a wood chip inlet and a pulp outlet; a distribution control system operatively connected to the chip refiner to perform process monitoring and process control functions; and means to perform the determination of the fibre filling factor of the fibre in the refining zone.

11. The apparatus according to claim 10, wherein said means to perform the determination is comprised in said distribution control system.

12. The apparatus according to claim 10, comprising a computer in operable connection with said distribution control system, said means to perform the determination being comprised in said computer.

13. The apparatus according to claim 11, further comprising an alarm controlled by said distribution control system, said alarm being triggered when a filling factor outside an acceptable range is determined, and said distribution control system adjusting said at least one operating parameter in response to said alarm.

14. The apparatus according to claim 12, further comprising an alarm controlled by said distribution control system, said alarm being triggered when a filling factor outside an acceptable range is determined, and said distribution control system adjusting said at least one operating parameter in response to said alarm.

15. A method according to claim 2, wherein in response to a determination of a filling factor outside an acceptable range, said at least one operating parameter is adjusted to restore the filling factor to the acceptable range.

16. A method according to claim 3, wherein in response to a determination of a filling factor outside an acceptable range, said at least one operating parameter is adjusted to restore the filling factor to the acceptable range.

17. A method according to claim 4, wherein in response to a determination of a filling factor outside an acceptable range, said at least one operating parameter is adjusted to restore the filling factor to the acceptable range.

18. A method according to claim 3, wherein said filling factor is monitored throughout the refining in the refining zone, and said at least one operating parameter is adjusted, as necessary, in response to the determined filling factor.

19. A method according to claim 18, carried out in an in-line process for producing wood pulp from wood chips.

20. A method according to claim 6, wherein said at least one operating parameter is selected from reduction of production rate, increase in production rate and reduction of energy input.

* * * * *